United States Patent [19]

Hemming

[11] Patent Number: 4,688,644

[45] Date of Patent: Aug. 25, 1987

[54] IGNITION AND FIRE SUPPRESSOR

[75] Inventor: Dale R. Hemming, Fridley, Minn.

[73] Assignee: Graco Inc., Minneapolis, Minn.

[21] Appl. No.: 851,105

[22] Filed: Apr. 14, 1986

[51] Int. Cl.[4] ..... A62C 37/04

[52] U.S. Cl. ..... 169/61; 239/691

[58] Field of Search ..... 169/61, 60, 54, 19, 169/16; 239/691, 289

[56] References Cited

U.S. PATENT DOCUMENTS

| | | | |
|---|---|---|---|
| 2,626,589 | 1/1953 | Lamm | 169/61 |
| 3,795,839 | 5/1974 | Walberg | 239/691 |
| 3,809,955 | 5/1974 | Parson | 361/100 |
| 3,875,892 | 4/1975 | Gregg | 118/4 |
| 3,894,272 | 7/1975 | Bentley | 361/42 |
| 4,075,677 | 2/1978 | Bentley | 361/235 |
| 4,402,030 | 8/1983 | Moser et al. | 361/235 |

FOREIGN PATENT DOCUMENTS

| | | | |
|---|---|---|---|
| 2819666 | 11/1979 | Fed. Rep. of Germany | 169/60 |
| 2532127 | 2/1984 | France | 239/691 |

*Primary Examiner*—Andres Kashnikow
*Assistant Examiner*—Michael J. Forman
*Attorney, Agent, or Firm*—Paul L. Sjoquist

[57] ABSTRACT

An ignition and fire suppressing system for an electrostatic sprayer of the type having a high voltage supply for creating an electrostatic charge and a nozzle in flow communication with a pressurized coating material source and a pressurized atomizing gas source. The system includes a high voltage arc-detecting circuit for sensing the presence of an ionizing arc or spark and for disabling the high voltage supply to the sprayer; a pressurized non-ignitable fire suppressing gas source in flow communication with the sprayer nozzle; and solenoid valves connected between the sprayer nozzle and the coating material, atomizing gas and fire suppressing gas sources which are actuated by an output from the arc-detecting circuit.

11 Claims, 1 Drawing Figure

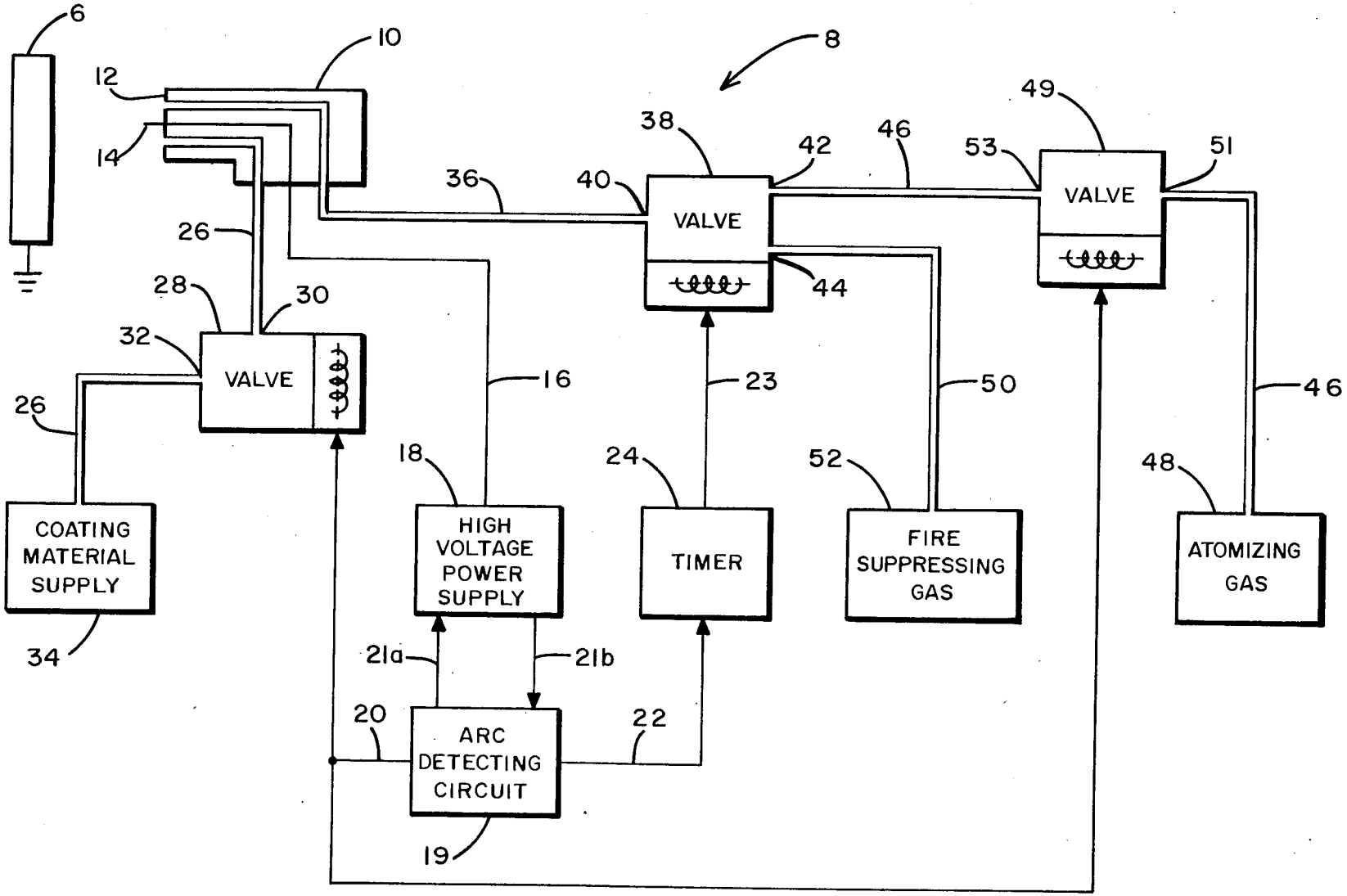
ATOMIZING GAS
VALVE
FIRE SUPPRESSING GAS
VALVE
TIMER
HIGH VOLTAGE POWER SUPPLY
ARC DETECTING CIRCUIT
VALVE
COATING MATERIAL SUPPLY
8
6
10
12
14
16
18
19
20
21a
21b
22
23
24
26
28
30
32
34
36
38
40
42
44
46
48
49
50
51
52
53

IGNITION AND FIRE SUPPRESSOR

BACKGROUND OF THE INVENTION

This invention relates to electrostatic sprayers, and more particularly to an ignition and fire suppressing system for such electrostatic sprayers.

Electrostatic spraying devices are widely used for the deposition of coating materials on articles to be finished or coated. Such devices usually include a sprayer from which a coating material is issued in an atomized form. Conduits connect an atomizing gas and the coating material to the sprayer. a high voltage power supply is also connected to the sprayer for charging the atomized coating material particles so that electrostatic forces will aid in attracting the coating material to the grounded article being finished. Such sprayers may be mechanically mounted and automatic or be hand held for manual operation.

Extremely high voltages, in the range of 60,000 to 120,000 volts, are required for imparting an adequate charge to the atomized material for successful and efficient deposition of spray coating materials by electrostatic means. Such high voltages present a problem of sparks or arcs which may occur between the electrostatic sprayer and the article to be coated or other nearby grounded objects. this arcing problem becomes critical where the atomized coating material or its organic carrying solution is extremely flammable. Ignition of these flammable materials could cause an explosion, a spray pattern fire about the sprayer or a fire on the article being coated.

Arc-detecting circuitry, which senses prospective ionizing sparks or arcs and shorts or turns off the high voltage power supply to avoid such hazardous conditions are repeatedly demonstrated in the prior art, U.S. Pat. Nos. 4,075,677, 3,894,272, 3,875,892, 4,402,030 and 3,809,955 disclose circuitry of that sort. Such circuitries typically sense a current surge in the high voltage power supply which is indicative of prospective arcs or sparks and either disconnect the high voltage power supply from the charging electrodes of the sprayer, or electrically connect the high voltage to ground.

Despite arc-detection circuitry, arcs and resultant fires do occur on occasion. In the past if a fire has occurred, conventional extinguishing means have typically been used. that is, hand-held fire extinguishers are utilized, or a switch or sensor for a fixed fire extinguishing system is activated. Such extinguishing means are timed to activate and put out the fire and often use chemicals which may contaminate the working area or articles to be coated.

SUMMARY OF THE INVENTION

An ignition and fire suppressing system for an electrostatic sprayer of the type having a high voltage power supply for creating an electrostatic charge and a nozzle in flow communication with a pressurized coating material source and a pressurized atomizing gas source. The system comprises a high voltage power supply with an arc-detecting circuit for sensing the presence of arcs or sparks and for turning off the high voltage supply when such current surge is sensed; a pressurized non-ignitable fire suppressing gas source in flow communication with the sprayer nozzle; and solenoid valves connected between the sprayer nozzle and the coating material, atomizing gas and fire suppressing gas sources, which are actuated by an output from the power supply's arc-detecting circuit.

During normal sprayer operation, the solenoid valves permit the flow of coating material and atomizing gas to the sprayer nozzle. At the sprayer nozzle, the coating material is atomized and electrostatically charged by the high voltage power supply. When a spark is sensed, the solenoid valves are actuated to interrup the flow of the coating material and atomizing gas to the sprayer nozzle and to permit the flow of the fire suppressing gas, such as nitrogen or carbon dioxide, to thereby suppress ignition of any flammable materials about the sprayer.

The ignition and fire suppressing system advantageously provides a system that will smother the ignition of a fire possibly even before the spark starts the fire about the sprayer or on the article being coated. Essentially, the sprayer itself becomes the extinguisher, thereby saving valuable time to extinguish a fire before it gets out of control or causes costly damage.

The use of non-ignitable gases in the system, such as nitrogen or carbon dioxide, will create a non-ignitable atmosphere about the sprayer and article being coated without contaminating the work area or surface being coated.

BRIEF DESCRIPTION OF THE DRAWINGS

FIG. 1 is a schematic drawing of the ignition and fire suppressing system according to the invention.

DESCRIPTION OF THE PREFERRED EMBODIMENT

Referring to FIG. 1, the ignition and fire suppressing system 8 includes a conventional electrostatic sprayer 10, high voltage power supply 18 with arc-detecting circuit 19, a pressurized coating material supply or source 34 and a pressurized atomizing gas supply or source 48. More specifically, electrostatic sprayer 10 has a sprayer nozzle 12 in flow communication with coating material supply 34, atomizing gas source 48 and fire suppressing gas supply 52. Coating material supply source 34 is connected to a conduit 26, which passes through a solenoid valve 28. Solenoid valve 28 has an inlet 32 coupled to conduit 26 and an outlet 30 coupled to conduit 26. Conduit 26 then is connected to electrostatic sprayer 10, wherein it passes through internal feed passages to nozzle 12. Atomizing gas source 48 is connected to a conduit or hose 46 which is connected to a solenoid valve 49. Solenoid valve 49 has an inlet 51 coupled to conduit 46, and an outlet 53 coupled to conduit 46. Conduit 46 is coupled into conduit 36 at valve 38, and conduit 36 is coupled to sprayer 10. Internal passages in sprayer 10 convey conduit 36 into nozzle 12. Fire suppressing gas supply 52 is connected to condit or hose 50, which is connected to inlet 44 of solenoid valve 38. Outlet 40 of solenoid valve 38 is coupled to conduit 36, which passes the spray gun 10 in a manner described hereinbefore.

Electrode 14, preferably adjacent sprayer nozzle 12, is connected to high voltage power supply 18 through high voltage cable 16 which may be flexible for a manual or hand-held sprayer operation. Power supply 18 may be a high voltage transformer of the Cockcroft-Walton type wherein the voltage across a transformer secondary winding is rectified and multiplied to produce sufficient high voltage in the range of 60,000 to 120,000 volts or more. U.S. Pat. Nos. 4,187,527 and 4,485,427 disclose such power supplies and are incorporated herein by reference.

Arc-detecting circuit 19 is of the type hereinbefore mentioned and incorporated herein by reference. Arc-detecting circuit 19 has two like electrical output lines 20 and 22. Line 20 is connected to solenoid valves 28 and 49, and a signal on line 20 will cause both solenoid valves 28 and 49 to actuate. Line 22 is connected to timer 24, and timer 24 is connected to solenoid valve 38, via line 23. A signal on line 22 will activate timer 24, and a predetermined time later timer 24 will develop a signal on line 23 to actuate solenoid valve 38. In some embodiments timer 24 may be eliminated from the circuit, wherein a signal on line 22 is coupled directly to line 23 to actuate solenoid valve 38.

Gas conduit 36 has one end connected to sprayer 10 and is in flow communication suitably with air jets or ports (not shown) in sprayer nozzle 12. The air jets in sprayer nozzle 12 are typically used for impinging against the coating material which is emitted from nozzle 12, with sufficient force and energy to cause atomization of the coating material, as is common with sprayers commonly referred to as air spray guns in the industry. Alternatively, the air jets in sprayer nozzle 12 may be used to shape or direct the sprayed coating material from nozzle 12 toward article 6. Sprayers which use this application of air may include centrifugal atomizers, wherein coating material atomization is accomplished through centrifugal forces imparted to the material by a high speed rotating member, and air jets are used merely to assist in directing the sprayed particles toward article 6. In one additional type of sprayer air jets are used to assist in the atomization of coating material which is emitted through nozzle 12 under high hydraulic pressure forces. This type of sprayer, commonly known as an air-assisted airless sprayer, generally uses very low pressure air in combination with very high pressure liquid to achieve proper coating material atomization.

The fire suppressing gas utilized in system 8 is preferably a non-ignitable gas such as nitrogen or carbon dioxide. Such gases will not contaminate the work area or the surface of article 6, but will smother a fire before it grows to any damage-causing magnitude.

In normal sprayer operation in which article 6 is being coated or finished, electrical current carried through line 20 causes two-way solenoid valve 28 to open to thereby permit coating materials from coating material supply 34 to flow through conduit 26 to sprayer 10 and ultimately to sprayer nozzle 12. High voltage power supply 18 is on and connected to electrode 14 in sprayer 10 through cable 16. Electrical current carried through line 20 also causes two-way solenoid valve 49 to open to thereby permit atomizing gas from atomizing gas supply 48 to flow through conduit 46 and conduit 36 to sprayer 10, and ultimately to nozzle 12. solenoid valve 38 normally has its inlet 44 closed thereby preventing fire suppressing gas from supply 52 from flowing through conduits 50 and 36 to sprayer 10 and sprayer nozzle 12. At sprayer nozzle 12 the coating materias are atomized and projected from sprayer nozzle 12 by the atomizing gas. Electrode 14 charges the atomized coating material particles to enhance their deposition on grounded article 6.

When an actual or impending ionizing arc or spark is detected by arc-detecting circuit 19 over line **21*b*, high voltage power supply 18 is turned off by circuit 19 over line 21*a* to eliminate any further arcing. The electrical current in line 20 to two-way solenoid valves 28 and 49 ceases. Two-way solenoid valve 28 turns off the flow of coating materials to sprayer nozzle 12. Two-way solenoid valve 49 turns off the flow of atomizing gas to sprayer nozzle 12. Arc-detecting circuit 19 initiates electrical current through line 22 to timer circuit 24. Timer circuit 24 may be selectively adjusted to permit immediate passage of current from line 22 to line 23, and to discontinue such current at predetermined time later. In the preferred embodiment the operating time of timer 24 is approximately 10 seconds, although greater or lesser times may be necessary in particular applications. Sprayer 10 effectively becomes a fire extinguisher to smother a sprayer pattern fire, a fire on the article or anywhere where sprayer 10** is directed.

Certain components have been found to be particularly useful in conection with the present invention. For example, timer 24 may be a time delay relay manufactured by Potter Brumfield, under Model No. CGA-38-790055. This time delay relay has a maximum of a 30 millisecond response time, which is advantageous for use in connection with the present invention. The solenoid valves 28, 38 and 49 are manufactured by SMC Pneumatics Inc., under Model Designation NVS 3125-0209N. These solenoid valves have a maximum response time of 25 milliseconds, and will operate under a minimum operating pressure of 250 pounds per square inch (psi). In certain applications where higher pressures are utilized other type solenoid valves may be necessary.

The operating pressures of the atomizing gas provided by atomizing gas source 48 may be regulated by commercially available pressure regulators, to a level which is required for suitable atomization at nozzle 12. The operating pressures which are utilized for the fire suppressing gas contained within source 58 may necessarily be required to be regulated to higher pressures. For example, it has been found that when carbon dioxide is used as the fire suppressing gas it is preferable to utilize pressures in the range of 80–100 psi, at flow rates of 30 cubic feet per minute into sprayer 10.

The present invention may be embodied in other specific forms without departing from the spirit or essential attributes thereof. That is, the system may be utilized with sprayers that are portable or fixed and automatic. It is therefore desired that the present embodiment be considered in all respects as illustrative and not restrictive, reference being made to the appended claims rather than to the foregoing description to indicate the scope of the invention.

That which is claimed is:

1. An ignition and fire suppressing system for an electrostatic sprayer, the sprayer having a high voltage power supply for creating an electrostatic charge and a nozzle in flow communication with a pressurized coating material source and an atomizing gas source, the system comprising (a) a detecting means for sensing the presence of an ionizing arc emanating from the sprayer and for disconnecting the high voltage power supply when such ionizing arc is detected, and for generating an external signal when such ionizing arc is detected;

(b) a pressurized fire suppressant source, and a pressurized atomizing gas source;

(c) a first signal-actuable valve means for selectively interrupting the flow communication between said coating material source and said nozzle;

(d) a second signal-actuable valve means for selectively interrupting the flow communication between said atomizing gas source and said nozzle;

(e) a third signal-actuable valve means coupled to said pressurized fire suppressant source and said nozzle for selectively introducing flow communication between said fire suppressant source and said nozzle; and (f) means for coupling said external signal to said first, second and third signal-actuable valve means for simultaneous actuation thereof.

2. The system of claim 1 wherein the detecting means comprises a high voltage arc-detecting circuit for sensing the presence of current surges in the high voltage supply which are indicative of the presence of an ionizing arc and for disconnecting the high voltage supply, the circuit having an electrical output for generating said external signal.

3. the system of claim 1 wherein the first valve means comprises a first two-way solenoid valve; the second valve means comprises a second two-way solenoid valve; and the third valve means comprises a third two-way solenoid valve.

4. The system of claim 1 further comprising a timer circuit intermediate the means connecting the detecting means and the third two-way solenoid valve.

5. The system of claim 1 wherein the fire suppressant is a non-ignitable gas.

6. The system of claim 1 wherein the fire suppressant is carbon dioxide gas.

7. The system of claim 1 wherein the fire suppressant is nitrogen gas.

8. The system of claim 1 wherein the coating material source, atomizing gas source and the fire suppressant source are connected to the sprayer by conduits.

9. The system of claim 1 wherein the detecting means is a high voltage arc-detecting circuit.

10. An ignition and fire suppressing system for an electrostatic sprayer, the sprayer having a high voltage supply for creating an electrostatic charge and a nozzle in flow communication with a pressurized coating material source and an atomizing gas source through conduits, the system comprising (a) a high voltage arc-detecting circuit for sensing the presence of an ionizing arc and for disabling the high voltage supply when a current surge is sensed, the circuit having an electrical output;

(b) a pressurized non-ignitable fire suppressing gas source in flow communication with the sprayer nozzle through a conduit;

(c) a first solenoid valve spliced into the conduits between the sprayer nozzle and the atomizing gas; a second solenoid valve spliced into the conduits between the sprayer nozzle and the fire suppressing gas source; the electrical output of the detecting circuit being connected to the first and second solenoid valves, the first solenoid valve adapted for permitting flow of the atomizing gas to the sprayer nozzle during normal sprayer operation and for interrupting the flow of the atomizing gas, the second solenoid valve adapted for interrupting the flow of fire suppressing gas during normal operation and permitting flow of the fire suppressing gas to the sprayer nozzle when the ionizing arc is detected; and (d) a third solenoid valve having an input connected to the conduit from the coating material source and an output connected to the conduit to the sprayer nozzle, the electrical output of the detecting circuit operably connected to the third valve, the third valve being adapted for permitting flow of the coating material to the sprayer nozzle during normal sprayer operation and for interrupting the flow of the coating material when an ionizing arc is detected to thereby suppress a fire.

11. The system of claim 10 wherein the fire suppressant gas is delivered under a pressure of between 80 and 100 pounds per square inch.

* * * * *